US010422042B2

(12) United States Patent
Goodreau et al.

(10) Patent No.: US 10,422,042 B2
(45) Date of Patent: Sep. 24, 2019

(54) METAL TREATMENT COATING COMPOSITIONS, METHODS OF TREATING METALS THEREWITH AND COATED METALS PREPARED USING THE SAME

(75) Inventors: Bruce H. Goodreau, Romeo, MI (US); Jianping Liu, S. Glastonbury, CT (US); Edis Kapic, Lake Orion, MI (US); Michael Febbraro, Ray Township, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 752 days.

(21) Appl. No.: 12/405,546

(22) Filed: Mar. 17, 2009

(65) Prior Publication Data

US 2009/0232996 A1 Sep. 17, 2009

Related U.S. Application Data

(60) Provisional application No. 61/037,153, filed on Mar. 17, 2008.

(51) Int. Cl.

| | |
|---|---|
| ***C23C 26/00*** | (2006.01) |
| ***C23C 10/30*** | (2006.01) |
| ***C23C 22/34*** | (2006.01) |

(52) U.S. Cl.

CPC ..... *C23C 26/00* (2013.01); *C23C 10/30* (2013.01); *C23C 22/34* (2013.01)

(58) Field of Classification Search

CPC ..... C09D 5/08; B05D 1/36

(Continued)

(56) References Cited

U.S. PATENT DOCUMENTS

| | | | |
|---|---|---|---|
| 1,710,743 | A | 4/1929 | Pacz |
| 4,643,778 | A | 2/1987 | Donofrio |

(Continued)

FOREIGN PATENT DOCUMENTS

| | | | |
|---|---|---|---|
| CN | 1159835 | A | 9/1997 |
| CN | 1179182 | A | 4/1998 |

(Continued)

OTHER PUBLICATIONS

International Search Report dated Sep. 1, 2011 for co-pending, co-owned PCT/US2010/062123, 4 pages. All references cited in the International Search Report are listed herein.

(Continued)

*Primary Examiner* — Jie Yang
(74) *Attorney, Agent, or Firm* — Mary K. Cameron

(57) ABSTRACT

Methods comprising: (a) providing a coating composition comprising a fluoroacid compound of the general formula (I):

$$X_pM_qF_rO_s \quad (I)$$

wherein each of q and r independently represents an integer of 1 to 10; each of p and s independently represents an integer from 0 to 10; X represents at least one cation selected from the group consisting of hydrogen, ammonium, alkaline earth metals and alkali metals; and M represents at least one element selected from the group consisting of Ti, Zr, Hf, Si, Sn, Al, Ge, and B; (b) contacting a metal substrate with the coating composition; and (c) adding to the coating composition a component selected from the group consisting of fluorine-free compounds of an element M, Group 2 metal compounds, Group 12 metal compounds, Group 13 compounds, Group 14 compounds, and combination thereof.

23 Claims, 2 Drawing Sheets

(58) Field of Classification Search
USPC ..... 427/419.8
See application file for complete search history.

(56) References Cited

U.S. PATENT DOCUMENTS

| | | | | |
|---|---|---|---|---|
| 5,342,456 | A | 8/1994 | Dolan | |
| 6,419,731 | B2 | 7/2002 | Inbe et al. | |
| 6,764,553 | B2 | 7/2004 | Dolan | |
| 7,063,735 | B2 | 6/2006 | Fristad et al. | |
| 7,510,612 | B2 | 3/2009 | Matsukawa et al. | |
| 7,531,051 | B2 * | 5/2009 | Nakayama et al. | 148/247 |
| 7,819,989 | B2 * | 10/2010 | Ishikura et al. | 148/273 |
| 2003/0150524 | A1 | 8/2003 | Wichelhaus et al. | |
| 2004/0054044 | A1 * | 3/2004 | Bittner et al. | 524/261 |
| 2004/0187967 | A1 | 9/2004 | Matsukawa et al. | |
| 2005/0067057 | A1 | 3/2005 | Ishikura et al. | |
| 2008/0057304 | A1 | 3/2008 | Fristad et al. | |
| 2008/0230395 | A1 | 9/2008 | Inbe et al. | |
| 2008/0302448 | A1 | 12/2008 | Frey et al. | |

FOREIGN PATENT DOCUMENTS

| | | | |
|---|---|---|---|
| CN | 1510165 | A | 7/2004 |
| CN | 1510166 | A | 7/2004 |
| CN | 1510168 | A | 7/2004 |
| CN | 101321894 | A | 12/2008 |
| CN | 101395299 | A | 3/2009 |
| DE | 764929 | C | 4/1954 |
| DE | 1933013 | A1 | 1/1971 |
| EP | 1405933 | A1 | 4/2004 |
| EP | 1433877 | A1 | 6/2004 |
| EP | 1433878 | A1 | 6/2004 |
| EP | 1571237 | A1 | 9/2005 |
| EP | 1489198 | B1 | 4/2008 |
| EP | 1997936 | A1 | 12/2008 |
| EP | 2154266 | A1 | 2/2010 |
| JP | 2004218073 | A | 8/2004 |
| JP | 2005264230 | A | 9/2005 |
| KR | 100326612 | B1 | 11/2002 |
| KR | 1020040058039 | A1 | 7/2004 |
| KR | 1020040058040 | A1 | 7/2004 |
| WO | 8505131 | A1 | 11/1985 |
| WO | 9305198 | A1 | 3/1993 |
| WO | 9320260 | A1 | 10/1993 |
| WO | WO2004063291 | A1 * | 7/2004 |
| WO | 2006108655 | A1 | 10/2006 |
| WO | 2007065645 | A1 | 6/2007 |
| WO | 2008075739 | A1 | 6/2008 |
| WO | 2010004651 | A1 | 1/2010 |

OTHER PUBLICATIONS

International Search Report dated Jun. 30, 2009 for co-pending, co-owned PCT/EP2009/053109, 6 pages. All references cited in the International Search Report were previously cited in the instant application in an IDS filed on Aug. 22, 2012.

German Search Report dated Feb. 5, 2009 for co-pending, co-owned PCT/EP2009/053109, 4 pages. All references cited in the International Search Report were previously cited in the instant application in an IDS filed on Aug. 22, 2012.

Lange's Handbook of Chemistry, 15th Ed., McGraw-Hill, 1999, Table 8.6, as cited by the Examiner in an office action dated Oct. 27, 2011 for co-pending, co-owned U.S. Appl. No. 12/884,359.

International Search Report for PCT/US09/37372, dated May 15, 2009, 1 page.

Supplementary European Search Report for EP 09722358, dated Aug. 13, 2014.

Supplementary EP Search Report for European Application 10844243.5 dated Oct. 5, 2017.

* cited by examiner

METAL TREATMENT COATING COMPOSITIONS, METHODS OF TREATING METALS THEREWITH AND COATED METALS PREPARED USING THE SAME

CROSS-REFERENCE TO RELATED APPLICATIONS

This application claims benefit of priority under 35 U.S.C. § 119(e) of U.S. provisional patent application Ser. No. 61/037,153, filed on Mar. 17, 2008, the entire contents of which are incorporated herein by reference.

BACKGROUND OF THE INVENTION

A coating is often applied to metal substrates, especially metal substrates that contain iron, such as steel, prior to the application of a protective or decorative coating. The coating can help to minimize the amount of corrosion to the metal substrate, if and when, the metal substrate is exposed to moisture and oxygen. Many of the presently known and used pretreatment coating compositions are based on metal phosphates, and some rely on a chrome-containing rinse. The metal phosphates and chrome rinse solutions produce waste streams that are detrimental to the environment. As a result, there is the ever-increasing cost associated with their disposal.

Coating compositions which can be applied without chrome rinse solutions are known. For example, the post-treating of phosphated metals with zirconium-containing rinse solutions has been described and is known in the art. However, such chrome-free, zirconium-containing rinse solutions are generally only suitable for use over a limited number of metal substrates, and the generation of metal phosphate waste streams is not alleviated.

Non-chrome coating compositions containing a fluoroacid such as fluorotitanic acid, silica, and a water-soluble polymer such as an acrylic acid polymer and/or a polymer with hydroxyl functionality have been described. By heating the silica and fluoroacid, the silica is dissolved, or at least partially dissolved until the solution is clear. As a result of their dissolution, the silica particles used in these coating compositions are not considered acid-stable particles. The pH of these compositions is very acidic, and ranges from 0 to 4, preferably from 0 to 1. The coatings compositions can enhance the corrosion resistance of steel and galvanized steel substrates.

Other coating compositions have been described for forming a coating on metal substrates, except aluminum. Such a coating composition can include an oxidative compound such as nitric acid or hydrogen peroxide, silicate or silicon dioxide particles, and a metal cation, oxymetal anion, or fluorometallate anion of Ti, Zr, Ce, Sr, V, W, and Mo.

Another non-chrome coating composition that contains a metallic surface-treating agent, water-dispersible silica, and one or more of a zirconium or titanium compound, thiocarbonyl compound, and a water-soluble acrylic resin has also been described. The metallic surface treating agents are silane coupling agents that are typically used in the coating industry to improve adhesion between the pre-coating and the decorative coating.

Another non-chrome coating composition that contains a cross-linked polymer system, which includes a copolymer with acrylic and hydroxyl functionality or the reaction product of an acrylic polymer and a polymer with hydroxyl functionality has also been described. A fluoroacid such as fluorozirconic acid or fluorotitanic acid can be added to these compositions. Such compositions with the addition of dispersed silica and an ammonium carbonate containing a group IVB metal have been described as well.

Unfortunately, while the use of chrome rinse solutions has decreased, and while various coating compositions have been suggested and used in place of phosphate compositions and chromate-based coatings, phosphate- and chromate-free pretreatment coatings for substrates, particularly multi-metal substrates, which exhibit the corrosion protection, adherence and other coating performance properties of known phosphate and chromate coatings have not been adequately provided in the art. In addition to failing to meet the corrosion, adherence and coating performance standards of prior phosphate- and chromate-containing coatings, known phosphate- and chromate-free coatings generally require large amounts of water and/or energy in use, and generally produce large amounts of sludge in application baths, the sludge having to be removed which results in less efficient operation and higher costs.

BRIEF SUMMARY OF THE INVENTION

The present invention relates, in general, to coating compositions for metal substrates, processes for making such compositions, methods of use for such compositions and coated substrates prepared using such compositions. More particularly, the present invention relates to chromate-free coating compositions having advantageous free fluoride contents, and preferably, both advantageous free fluoride contents and advantageous total fluoride contents; methods for their preparation and use including maintenance of free fluoride contents, and preferably total fluoride contents as well, of such compositions in use; and coated substrates prepared therewith. Methods and coating compositions in accordance with various embodiments of the present invention can provide coatings on metal surfaces which offer increased protection from corrosion, excellent adherence and coating properties, and are free from environmentally unsound chromate.

One embodiment of the present invention includes methods which comprise:

(a) providing a coating composition comprising a fluoroacid compound of the general formula (I):

$$X_pM_qF_rO_s \quad (I)$$

wherein each of q and r independently represents an integer of 1 to 10; each of p and s independently represents an integer from 0 to 10; X represents at least one cation selected from the group consisting of hydrogen, ammonium, alkaline earth metals and alkali metals; and M represents at least one element selected from the group consisting of Ti, Zr, Hf, Si, Sn, Al, Ge, and B;

(b) contacting a metal substrate with the coating composition; and (c) adding to the coating composition a component selected from the group consisting of fluorine-free compounds of an element M as defined above, Group 2 metal compounds, Group 12 metal compounds, Group 13 compounds, Group 14 compounds, and combinations thereof.

In various preferred embodiments of such methods, the methods can include (c) adding to the coating composition a fluorine-free compound of an element M wherein M in the fluorine-free compound is the same M as in formula (I), and a component selected from the group consisting of other fluorine-free compounds of an element M, Group 2 metal compounds, Group 12 metal compounds, Group 13 compounds, Group 14 compounds, and combinations thereof.

Another embodiment of the invention includes coating compositions which comprise:

(a) a fluoroacid compound of the general formula (I):

$$X_pM_qF_rO_s \quad (I)$$

wherein each of q and r independently represents an integer of 1 to 10; each of p and s independently represents an integer from 0 to 10; X represents at least one cation selected from the group consisting of hydrogen, ammonium, alkaline earth metals and alkali metals; and M represents at least one element selected from the group consisting of Ti, Zr, Hf, Si, Sn, Al, Ge, and B;

(b) acid-stable particles; and (c) a component selected from the group consisting of fluorine-free compounds of an element M as defined above, Group 2 metal compounds, Group 12 metal compounds, Group 13 compounds, Group 14 compounds, and combinations thereof.

In various preferred embodiments of such compositions, the compositions can include a fluorine-free compound of an element M wherein M in the fluorine-free compound is the same M as in formula (I), optionally in addition to or in place of other fluorine-free compounds of an element M.

Another embodiment of the present invention includes articles comprising a substrate having a metal surface, wherein at least a portion of the metal surface is coated by a method or with a coating composition according to any of the various embodiments of the present invention.

Yet another embodiment of the present invention includes methods for preparing coating compositions, the methods comprising:

(a) providing a fluoroacid compound of the general formula (I):

$$X_pM_qF_rO_s \quad (I)$$

wherein each of q and r independently represents an integer of 1 to 10; each of p and s independently represents an integer from 0 to 10; X represents at least one cation selected from the group consisting of hydrogen, ammonium, alkaline earth metals and alkali metals; and M represents at least one element selected from the group consisting of Ti, Zr, Hf, Si, Sn, Al, Ge, and B; acid-stable particles; and a component selected from the group consisting of fluorine-free compounds of an element M as defined above, Group 2 metal compounds, Group 12 metal compounds, Group 13 compounds, Group 14 compounds, and combinations thereof; and (b) mixing the fluoroacid, acid-stable particles and the component in water.

In various preferred embodiments of such methods, the component can include a fluorine-free compound of an element M wherein M in the fluorine-free compound is the same M as in formula (I), optionally in addition to or in place of other fluorine-free compounds of an element M.

In various preferred embodiments of methods and compositions according to the present invention, M in the general formula (I) represents zirconium (Zr). Also, in various preferred embodiments of methods and compositions according to the present invention, the component includes basic zirconium carbonate. Furthermore, in various preferred embodiments of methods and compositions according to the present invention, the coating compositions further comprise divalent metal ions, such as, for example, $Cu^{2+}$ ions.

In various preferred embodiments of methods according to the present invention, the methods further comprise determining free fluoride content of the coating composition. In various preferred embodiments of methods according to the present invention, the methods further comprise determining free fluoride content of the coating composition and total fluoride:element M molar ratio of the coating composition. Also, in various preferred embodiments of methods according to the present invention, the methods further comprise adding the component to the coating composition to adjust the free fluoride content to a desired value, and in various preferred embodiments to adjust both the free fluoride content and total fluoride:element M molar ratio to desired values.

Additionally, in various preferred embodiments of methods according to the present invention, where the free fluoride content is determined and/or adjusted, a suitable desired value is about 5 to about 155 ppm, preferably about 10 to about 100 ppm, and in increasing order of preference, from about 5 or about 10 to: below about 100 ppm; below about 85 ppm; below about 80 ppm; below about 75 ppm; below about 55 ppm; below about 45 ppm; below about 32.5 ppm; below about 30 ppm; below about 27.5 ppm; below about 25 ppm; below about 22.5 ppm; and below about 20 ppm. Suitable desired free fluoride contents can include values below 5 ppm so long as the metal M (e.g., Zr) is stable in the composition (i.e., does not precipitate). As the value of free fluoride approaches zero precipitation is more likely to occur. Moreover, suitable desired free fluoride contents can include values above 155 ppm while maintaining advantageous corrosion properties but coating weight can begin to deteriorate.

Additionally, in various preferred embodiments of methods according to the present invention, where total fluoride: element M molar ratio is determined and/or adjusted, a suitable desired value is, in increasing order of preference, approximately: 4:1 to 24:1; 4:1 to 18:1; 4:1 to 17.5:1; 4:1 to 17:1; 4:1 to 16:1; 4:1 to 15:1; 4:1 to 14:1; 4:1 to 13:1; 4:1 to 12:1; 4:1 to 11:1; 4:1 to 10:1; 4:1 to 9:1; and 4:1 to 8.5:1.

It has been surprisingly found that the addition of one or more various components, such as fluorine-free compounds of an element M as defined above (e.g., basic zirconium carbonate), Group 2 metal compounds (e.g., calcium and/or magnesium salts), Group 12 metal compounds (e.g., zinc salts), Group 13 compounds, and Group 14 compounds (e.g., silicon, aluminum and/or boron compounds), and optionally also fluorine-free compounds of an element M wherein M in the fluorine-free compound is the same M as in formula (I), to fluorometallate metal treatment compositions can improve the corrosion protection afforded by the coatings which result from such treatments. Compositions and methods in accordance with the present invention are suitable for use on composite metal substrates containing two or more different metals, the coating adhere very well, and coating weight is not adversely affected by the addition of the various added components.

It has surprisingly been found that adjustment and/or maintenance of coating compositions such that the free fluoride content, and optionally the total fluoride:element M molar ratio, of the compositions is (are) at a desired value can improve the corrosion protection provided by coatings prepared on metal surfaces using such compositions.

In accordance with the various embodiments of the present invention, both total fluoride:element M molar ratio and free fluoride content of the composition can be adjusted, and the desired value for each coating composition property can be selected from any of the aforementioned values in combination with one another. Thus, each and every combination of the aforementioned desired values for each of total fluoride:element M molar ratio and free fluoride content is encompassed within the scope of the present invention. For example, the coating composition properties can be adjusted in accordance with various embodiments of the present invention such that total fluoride:element M molar ratio is 4:1 to 18:1 and free fluoride content is below about 50 ppm, or such that total fluoride:element M molar ratio is 4:1 to 12:1 and free fluoride content is below about 75 ppm, or such that total fluoride:element M molar ratio is 4:1 to 8.5:1 and free fluoride content is below about 25 ppm, etc.

BRIEF DESCRIPTION OF THE SEVERAL VIEWS OF THE DRAWING

The foregoing summary, as well as the following detailed description of the invention, may be better understood when read in conjunction with the appended drawings. For the purpose of assisting in the explanation of the invention, there are shown in the drawings representative embodiments which are considered illustrative. It should be understood, however, that the invention is not limited in any manner to the precise arrangements and instrumentalities shown.

In the drawings.

DETAILED DESCRIPTION OF THE INVENTION

Figure 1:
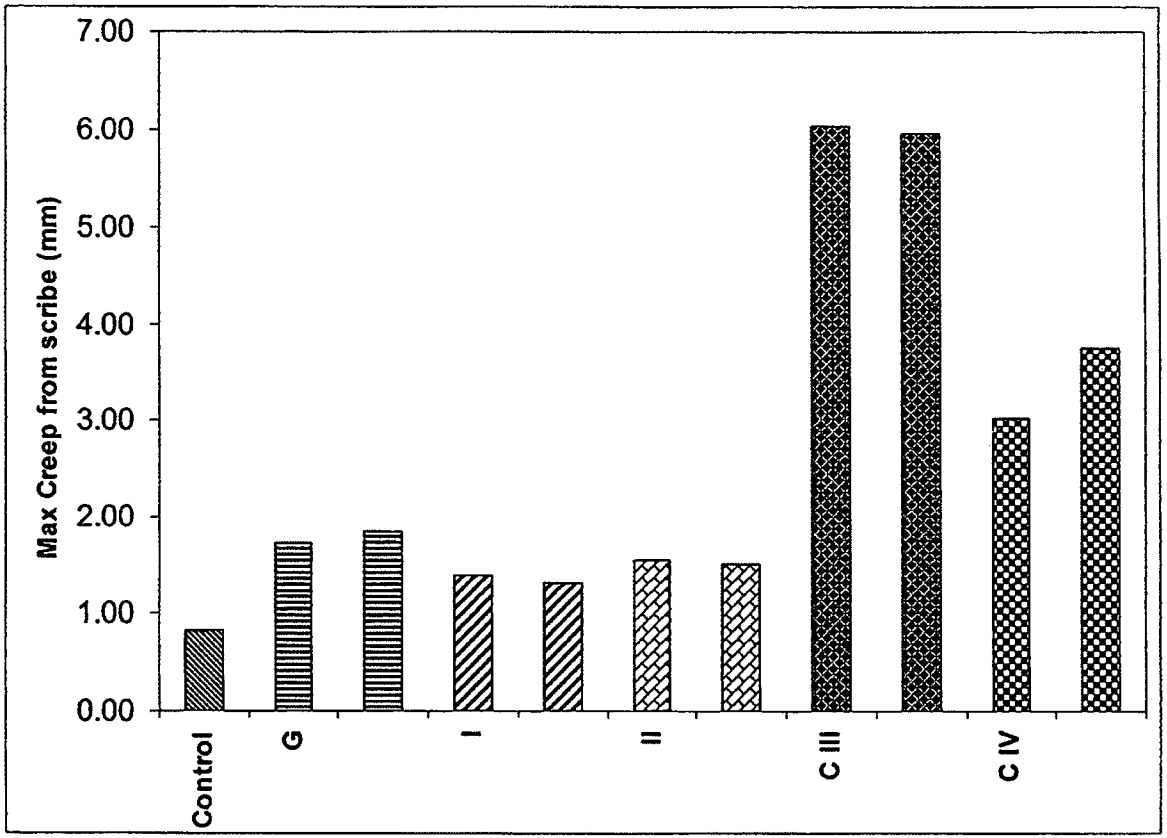
FIG. 1 is a graphical comparison of the corrosion protection provided by compositions according to three embodiments the present invention and two comparative compositions.

As used herein, the singular terms "a" and "the" are synonymous and used interchangeably with "one or more" and "at least one," unless the language and/or context clearly indicates otherwise. Accordingly, for example, reference to "a fluoroacid" herein or in the appended claims can refer to a single fluoroacid or more than one fluoroacid. Additionally, all numerical values, unless otherwise specifically noted, are understood to be modified by the word "about." All references to percentages and ratios, unless otherwise noted, are by weight.

The present invention includes methods which comprise providing a coating composition, contacting a metal substrate with the coating composition; and adding one or more selected components to the coating composition. The one or more components can be added to the coating composition at any time, i.e., before, after and/or during the contacting of the metal substrate with the coating composition. Addition of a selected component to the coating composition can occur between contacting multiple individual substrates with the coating composition.

Coating compositions provided in accordance with the various method embodiments of the present invention include a fluoroacid. Fluoroacids suitable for use in the coating compositions according to the various embodiments of the present invention include acid fluorides and/or acid oxyfluorides with an element selected from the group consisting of Ti, Zr, Hf, Si, Sn, Al, Ge and B. A suitable fluoroacid should preferably be water-soluble and preferably comprise at least 1 fluorine atom and at least one atom of an element selected from the group consisting of Ti, Zr, Hf, Si, Sn, Al, Ge or B. Such suitable fluoroacids are sometimes referred to by workers in the field as "fluorometallates".

Suitable fluoroacids can be defined by the following general formula (I):

$$X_pM_qF_rO_s \quad (I)$$

wherein: each of q and r represents an integer from 1 to 10; each of p and s represents an integer from 0 to 10; X represents hydrogen or suitable cations such as ammonium, metal, alkaline earth metal or alkali metal cations; and M represents a metal, semimetal or metalloid element selected from the group consisting of Ti, Zr, Hf, Si, Sn, Al, Ge, and B. The element represented by "M" is herein also referred to simply as "the fluoroacid metal," "the metal" and/or "the M element," for convenience, even though some of the elements represented by M (e.g., Si) are not technically metals. Preferred fluoroacids of general formula (I) include those wherein M represents Ti, Zr, or Si; p is 1 or 2; q is 1; r is 2, 3, 4, 5, or 6; and s is 0, 1, or 2. A particularly preferred fluoroacid is $H_2ZrF_6$.

While fluoroacids where X represents hydrogen are preferred, one or more of the H atoms may be replaced by suitable cations such as ammonium, metal, alkaline earth metal or alkali metal cations (e.g., the fluoroacid can be in the form of a salt, provided such salt is water-soluble or water-dispersible). Examples of suitable fluoroacid salts include $(NH_4)_2SiF_6$, $MgSiF_6$, $Na_2SiF_6$ and $Li_2SiF_6$.

Preferred fluoroacids suitable for use in the coating compositions of the invention include fluorotitanic acid ($H_2TiF_6$), fluorozirconic acid ($H_2ZrF_6$), fluorosilicic acid ($H_2SiF_6$), fluoroboric acid ($HBF_4$), fluorostannic acid ($H_2SiF_6$), fluorogermanic acid ($H_2GeF_6$), fluorohafnic acid ($H_2HfF_6$), fluoroaluminic acid ($H_3AlF_6$), and salts of each thereof. More preferred fluoroacids are fluorotitanic acid, fluorozirconic acid, fluorosilicic acid, and salts of each thereof. Some of the salts that can be used include alkali metal and ammonium salts, e.g., $Na_2MF_6$ and $(NH_4)_2$ $MF_6$, where M is Ti, Zr, and Si. A particularly preferred fluoroacid is fluorozirconic acid.

The concentration of the one or more fluoroacids, calculated based on the metal in the fluoroacid, in the coating compositions of the invention can be relatively quite low. For example, a fluoroacid concentration of about 5 ppm (calculated as M, e.g., Zr) can be used, and still provide corrosion resistant coatings (ppm parts per million). The concentration of the one or more fluoroacids in the coating composition is from about 5 ppm (about 0.0005% by weight) to about 10,000 ppm (about 1.0% by weight), preferably from about 5 ppm to about 5000 ppm. Preferred concentrations of the one or more fluoroacids in the coating compositions include from about 5 ppm to about 3000 ppm, more preferably from about 10 ppm to about 1000 ppm. The final concentration, of course, will depend upon the amount of water used to prepare the coating compositions of the invention.

Coating compositions provided in accordance with the various method embodiments of the invention can further comprise acid-stable particles. Particles are considered acid-stable if the change in viscosity as measured in a test sample, as described herein under the subheading, "Test procedure for acid-stable particles", is ten seconds or less, preferably five seconds or less. In the most preferred embodiments, the acid-stable particles will have a change in viscosity of one second or less. Typically, the lower the change in viscosity the more stable the particles are in acid, that is, in an aqueous solution with a pH of 3 to 7.

The term "change in viscosity" used herein reflects the viscosity measurement made in accordance with the test procedure described below. Some acid-stable particles suitable for use in compositions according to the invention, when subjected to the test procedure described below, can over 96 hours actually decrease in viscosity such that the measured change in viscosity is less than zero.

Test Procedure for Acid-Stable Particles:

A sodium acetate/acetic acid buffer with a pH of about 5.0 is prepared by acidifying the solution with hydrochloric acid. To 20 mL of buffer solution, 20 mL of the selected particles, as an aqueous dispersion, are added. As a test sample, the particle dispersion should have a solids concentration of about 30 wt %. If the selected particle dispersion has a higher wt %, dilute the dispersion to 30 wt %. The solution is then stirred for ten minutes. The viscosity of the solution is measured after stirring as time zero, and then measured again after standing at room temperature for 96 hours.

The viscosity measurement can be carried out using a Zahn Cup apparatus from Gardner Laboratory Division, Pacific Scientific Co. The Zahn viscosity cup is a small U-shaped cup suspended from a wire. The cup has an orifice, which is available in various sizes, at its base. For example, the #2 Zahn cup used in the acid stability test is certified to ASTM D4212 with an orifice diameter of 2.69 mm. The viscosity of a sample is measured by completely submerging the cup into the test sample. The cup is then completely withdrawn from the sample. The time in seconds from the moment the top of the cup emerges from the sample until a portion of the stream breaks free from the stream falling through the orifice is the measure of the viscosity of the sample. Thus, the change in viscosity of the solution is the time in seconds measured after 96 hours, minus the time in seconds measured at time zero.

Alternatively, one of ordinary skill can determine if particles are acid-stable by preparing an acidified test sample containing the particles as described, and simply observing whether there is any visible indication of thickening, precipitation or gelling over about 96 hours at room temperature.

Suitable acid-stable particles which can be used in coating compositions and method according to the present invention include, but are not limited to, silica particles provided as a colloidal suspension, such as, for example, colloidal silica suspensions available from Grace Davison under the trademark Ludox® TMA, Ludox® AM, Ludox® SK, and Ludox® SK-G. These specific types of silica particles are treated with an aluminum compound. For example, Ludox® AM has a weight ratio of $SiO_2$:$Al_2O_3$ from about 140:1 to 180:1. Aluminum-modified silica such as Adelite® AT-20A obtained from Asahi Denka can also be used.

The acid-stable particles can be relatively spherical in shape with an average diameter from about 2 nm to about 80 nm, or from about 2 nm to about 40 nm, as measured by transmission electron microscopy (TEM). The particles can also be rod-shaped with an average length from about 40 nm to about 300 nm, and an average diameter from about 5 nm to about 20 nm. The particles can be provided as a colloidal dispersion, e.g., as a mono-dispersion in which the particles have a relatively narrow particle size distribution. Alternatively, the colloidal dispersion can be poly-dispersed in which the particles have a relatively broad particle size distribution.

The silica particles are typically in the form of discrete spheres suspended in an aqueous medium. The medium can also contain a polymer to improve stability of the colloidal suspension. The polymer can be one of the listed polymers provided below. For example, certain commercially available formulations include a polymer to maintain stability of the dispersion during storage. For example, Ludox® SK and Ludox® SK-G are two commercial forms of colloidal silica that contain a polyvinyl alcohol polymer.

It is to be understood, that the coating compositions do not require the presence of a polymer to maintain acid stability of the compositions at a pH from 2 to 7, However, in some applications, a polymer can be added to the coating compositions to provide even greater acid stability.

The concentration of acid-stable particles in the compositions of the invention depends on the type of particles used and the relative size, e.g., average diameter, of the particles. The coating compositions will contain from 0.005% to 8% by weight, 0.006% to 2% by weight, 0.007% to 0.5% by weight, or from 0.01% to 0.2% by weight, on a dry weight basis of acid-stable particles.

Acid-stable silica particles can be aluminum-modified silica particles. Aluminum-modified silica particles will have a weight ratio of $SiO_2$:$Al_2O_3$ from about from about 80:1 to about 240:1, and from about 120:1 to about 220:1. The concentration of aluminum-modified silica particles in the compositions of the invention is from 0.005% to 5% by weight, 0.006% to 1% by weight, 0.007% to 0.5% by weight, or from 0.01% to 0.2% by weight, on a dry weight basis of acid-stable particles.

In another embodiment, the acid-stable particles can be nonaluminum-modified silica particles. These silica particles are modified by some process, at times a proprietary process, that is not considered by those skilled in the art to be an aluminum modification process. The nonaluminum-modified silica particles are negatively charged and have a majority of silicon acid sites neutralized, for example, by sodium or ammonia. Examples of nonaluminum-modified silica particles that can be used in the coating compositions include colloidal particles from Nissan Chemical sold under the trademark Snowtex® O and Snowtex® N. The concentration of nonaluminum-modified silica particles in the compositions of the invention is from 0.005% to 5% by weight, 0.006% to 1% by weight, 0.007% to 0.5% by weight, or from 0.01% to 0.2% by weight, on a dry weight basis of acid-stable particles.

Coating compositions according to various embodiments of the present invention may also preferably contain a source of divalent metal ($M^{2+}$) ions, preferably copper ($Cu^{2+}$) ions, such as, for example, copper nitrate. One or more divalent metals, preferably copper, can be included in the coating compositions according to the invention in amounts of 5 to 50 ppm. Preferred amounts of divalent metal ion can vary according to the particular method of application of coating composition. For example, when a coating composition in accordance with the various embodiments of the present invention is applied to a metal substrate via immersion, a preferred content of divalent metal ion can be 10-30 ppm. Preferred amounts of divalent metal ion used when a coating composition in accordance with the various embodiments of the present invention is applied to a metal substrate via spraying can be 5-15 ppm.

Coating compositions of the invention also contain water. Water is used to dilute the coating composition of the invention, and provides relatively long-term stability to the composition. For example, a composition that contains less than about 40% by weight water is more likely to polymerize or "gel" compared to a coating composition with about 60% or greater by weight water under identical storage conditions. Although the coating compositions of the invention typically applied to the substrate will contain about 92% water or greater, it is to be understood that a coating composition of the invention also includes a concentrated formulation composition with 60% to 92% by weight water. The end-user simply dilutes the concentrated formulation with additional water to obtain an optimal coating composition concentration for a particular coating application.

The coating composition of the invention can be provided as a ready-to-use coating composition, as a concentrated coating composition that is diluted with water prior to use, as a replenishing composition, or as a multi-component coating system. In a two-component coating system the fluoroacid is stored separately from the particles. The fluoroacid and the particles are then mixed prior to use by the end-user.

The concentration of each of the respective constituents of the coating compositions will, of course, be dependent upon whether the coating composition to be used is a replenishing coating composition, a concentrated coating composition, or a ready-to-use coating composition. A replenishing coating composition can be provided to and used by an end-user to restore an optimal concentration of constituents of a coating composition to a coating bath as the constituents are consumed during the coating of substrates. As a result, a replenishing coating composition will necessarily have a higher concentration of acid-stable particles or fluoroacids than the coating composition used to coat the substrate.

In the various embodiments of the methods according to the present invention, a metal substrate is contacted with the coating composition. A coating composition of the invention can be applied to a metal substrate to form a corrosion resistant coating. Metal substrates that can be passivated provided with enhanced corrosion resistance) by the coating compositions of the invention and contacted therewith in the methods of the invention include cold rolled steel, hot-rolled steel, stainless steel, steel coated with zinc metal, zinc alloys such as electrogalvanized steel, galvalume, galvanneal, and hot-dipped galvanized steel, aluminum alloys and aluminum plated steel substrates. The invention also offers the advantage that components containing more than one type of metal substrate can be passivated in a single process because of the broad range of metal substrates that can be passivated by the coating compositions of the invention.

The metal substrate is usually cleaned to remove grease, dirt, or other extraneous materials by using conventional cleaning procedures and materials, e.g., mild or strong alkaline cleaners. The metal substrate is then rinsed with water or an aqueous acidic solution.

A coating composition of the invention is applied to the metal substrates in any number of ways known in the art. Two of the most preferred methods are spraying and immersion. The thickness and composition of the cured coating on the metal substrate depends on a number of factors including particle size, particle concentration, and exposure time or time in contact with the coating composition.

The coatings of the invention generally have a coating weight of 5 mg/sq ft to 500 mg/sq ft, and preferably 20 mg/sq ft to 150 mg/sq ft. Coating weights can vary by substrate.

Following treatment of a metal substrate with a coating composition, the coating composition can be dried in place on the surface of the metal substrate. Alternatively, the applied coating composition can be rinsed, preferably with water, to remove excess coating composition, and then dried. The drying can be done at any temperature. Typical convenient temperatures are from 100° F. to 300° F. The drying conditions selected depend upon the customer's preferences, space available, and the type of finish coating used. For example, a powder coating typically requires a dry surface prior to application compared to a water-based coating. Alternatively, for example, where an aqueous electrocoat paint is to be applied, drying is not necessary.

In the various embodiments of the methods according to the present invention, one or more components selected from the group consisting of fluorine-free compounds of an element M as defined above, Group 2 metal compounds, Group 12 metal compounds, Group 13 compounds, Group 14 compounds, and combinations thereof is added to the coating composition. As discussed above, the one or more components can be added before, during and/or after contacting a metal substrate with the coating composition.

Fluorine-free compounds of an element M suitable for addition to a coating composition in accordance with the present invention include, for example, various oxides, carbonates, nitrates, and sulfates, of Ti, Zr, Hf, Si, Sn, Al, Ge, and/or B. Preferably, the element M of the fluorine-free compound is the same as the element M of the fluoroacid. Thus, for example, if the fluoroacid comprises a fluorozirconate, a fluorine-free zirconium compound can be added to the coating composition. In various preferred embodiments, where the fluoroacid comprises zirconium, the fluorine-free compound comprises basic zirconium carbonate.

Suitable Group 2 metal compounds and Group 12 metal compounds which can be added to the coating composition in accordance with the present invention include, but are not limited to, calcium, magnesium and zinc salts. A preferred compound is zinc nitrate.

Suitable Group 13 compounds and Group 14 compounds which can be added to the coating composition in accordance with the present invention include, but are not limited to, silicon, aluminum and boron oxides, nitrates and sulfates.

In various preferred embodiments of methods according to the present invention, combinations of fluorine-free compounds of an element M as defined above, Group 2 metal compounds, Group 12 metal compounds, Group 13 compounds, and Group 14 compounds are added to the coating composition. For example, in a preferred embodiment, a combination of basic zirconium carbonate and zinc nitrate are added to the coating composition.

In various preferred embodiments of methods according to the present invention, the methods further comprise determining free fluoride content of the coating composition. As used herein, free fluoride refers to unbound, uncomplexed fluoride ions present in the composition. In various preferred embodiments of methods according to the present invention, the methods further comprise determining free fluoride content of the coating composition and total fluoride:element M molar ratio of the coating composition. Total fluoride refers to the amount of free fluoride and all fluoride bound or complexed as either a fluoro compound or a polyatomic ion. In various preferred embodiments of methods according to the present invention, the free fluoride content, and optionally the total fluoride:element M molar ratio, value(s) can be determined such that the one or more components can be added to the coating composition to adjust the coating composition property(ies) to a desired value(s).

As used herein, "determining" does not necessarily require any particular degree of accuracy or precision. Moreover, it does not necessarily imply a specific measurement. Determining either or both values can include estimation, calculations based on composition usage and metal content in coatings prepared using the composition, etc.

Thus, either free fluoride content, total fluoride:element M molar ratio, or both can be determined and the one or more components can be added to adjust the property to a desired value. The amount of element M can be increased, without affecting the concentration of fluorine, via the addition of a fluorine-free compound of element M. The addition of fluorine-free compounds of an element M, Group 2 metal compounds, Group 12 metal compounds, Group 13 compounds, and/or Group 14 compounds can adjust the content of free fluorine.

When adjusting the total fluoride:element M molar ratio, if determined by measurement, a desired value can be 4:1 to 24:1. More preferably, the total fluoride:element M molar ratio is adjusted to 4:1 to 18:1, and in increasing order of preference to values of 4:1 to 17.5:1; 4:1 to 17:1; 4:1 to 16:1; 4:1 to 15.1; 4:1 to 14:1; 4:1 to 13:1; 4:1 to 12:1; 4:1 to 11:1; 4:1 to 10:1; 4:1 to 9:1; and 4:1 to 8.5:1.

When adjusting the free fluoride content, if determined by measurement, a suitable desired value is about 5 to about 155 ppm, preferably about 10 to about 100 ppm, and in increasing order of preference, from about 5 or about 10 to: below about 100 ppm; below about 85 ppm; below about 80 ppm; below about 75 ppm; below about 55 ppm; below about 45 ppm; below about 32.5 ppm; below about 30 ppm; below about 27.5 ppm; below about 25 ppm; below about 22.5 ppm; and below about 20 ppm.

In various preferred embodiments of the invention, free fluoride content of a coating composition is determined by measurement, and preferably adjusted with subsequent measurement to determine the resulting or adjusted value. Such determination, adjustment and subsequent determination can be carried out one or multiple times during use of a coating composition. In various embodiments of the present invention, both the total fluoride:element M molar ratio and the free fluoride content are adjusted to desired values. Combinations of desired values can include any combination of the above-mentioned values.

The content of free fluoride can be determined by measurement with an ion selective electrode by measuring the relative millivolts (RmV) of the composition using an ion selective electrode relative to a standard fluoride solution. Free fluoride content is directly proportional to RmV. Total fluoride:element M molar ratio can be determined by measurement with an ion selective electrode in combination with other analytical methods known in the art. For example, total fluoride can be determined by first treating a sample with one or more reagents that cause the release of any complexed and/or bound F, then using an ion selective electrode to measure the fluoride content. In conjunction with such a total fluoride measurement, standard metal analytical techniques, such as, for example, ICP (inductively coupled plasma) and photometric techniques, can be used to determine M content.

As discussed above, either or both values can be estimated or calculated, but preferably, determining either value includes a measurement.

The invention will now be described in further detail with reference to the following non-limiting examples.

EXAMPLES

APGE Test Evaluation on CRS

Examples G, 1 & 2 and Comp. Ex. 3 & 4

Three coating compositions in accordance with embodiments of the present invention, (G, I and II), were prepared by mixing the component shown below in Table 1a with water to form aqueous coating compositions. Additionally, as shown in Table 1a, two comparative formulations, (CIII and CIV), were similarly prepared. Finally, a control sample was prepared.

TABLE 1a

| Formula # | Zr (H2ZrF6) (ppm) | Zr (ZBC) (ppm) | Si (ppm) | $SiO_2$ (ppm) | Cu (ppm) | F (ppm) | Zn (ppm) |
|---|---|---|---|---|---|---|---|
| G | 775 | — | 10 | — | 20 | — | 250 |
| I | 128 | 22 | — | 50 | 20 | — | 250 |
| II | 128 | 22 | — | 50 | 20 | — | — |
| CIII | 150 | — | — | 50 | 20 | 400 | 250 |
| CIV | 150 | — | — | 50 | 20 | 400 | — |
| Control | 150 | — | — | 50 | 20 | — | — |

As shown below in Table 1b, the corrosion protection provided by Formula G, Formula I and Formula II, is superior to the protection provided by Comparative Formula III and Comparative Formula IV. After a 15 cycle APGE Test (FLTM BI123-01), the maximum creep distance from the scribe on the coated cold-rolled steel for Formulae G, I and II was less than half that of Formulae III and IV. Though not as protective as the Control Example, the inventive compositions are far closer than comparative Formulae III and IV. The data presented below in Table 1b are shown graphically in FIG. 1.

TABLE 1b

| | | Max Creep from Scribe (mm) | | | | | |
|---|---|---|---|---|---|---|---|
| Samples | Formula | 1st | 2nd | 3rd | 4th | average | |
| Control | Control | 0.88 | 0.82 | 0.82 | 0.76 | 0.82 | |
| A1-1 | G | 2.64 | 1.32 | 1.65 | 1.34 | 1.74 | 1.85 |
| A1-2 | | 1.74 | 2.10 | 1.76 | 1.78 | 1.85 | |
| A2-1 | I | 1.72 | 1.18 | 1.23 | 1.44 | 1.39 | 1.31 |
| A2-2 | | 1.35 | 1.39 | 1.29 | 1.22 | 1.31 | |
| A3-1 | II | 1.50 | 1.97 | 1.38 | 1.37 | 1.56 | 1.52 |
| A3-2 | | 1.64 | 1.44 | 1.47 | 1.51 | 1.52 | |
| A4-1 | CIII | 5.86 | 6.27 | 6.65 | 5.37 | 6.04 | 5.96 |
| A4-2 | | 5.82 | 5.48 | 6.51 | 6.04 | 5.96 | |
| A5-1 | CIV | 2.88 | 3.54 | 3.16 | 2.51 | 3.02 | 3.77 |
| A5-2 | | 3.31 | 3.79 | 4.46 | 3.50 | 3.77 | |

The creep values shown in Table 1b were determined by measuring the distance from the scribe line to the end of the furthest line of corrosion, Corrosion was evaluated after 15 cycles. Each panel of cold-rolled steel was pre-treated with a composition, (G, I, II, III or IV), and then coated with a paint topcoat. A scribe line was drawn across 80-80% of the panel width at a depth exposing the substrate.

Free Fluoride Study:

Coating compositions in accordance with various embodiments of the present invention were prepared by mixing the ingredients shown below as Formula 1-8. A fluoride salt, namely ammonium bifluoride ($NH_4HF_2$) in Formula 3 & 4, was added to artificially age the composition bath by increasing free fluoride content.

Formula 1 F/Zr: 5:1

| Raw Material | Molecule formula | Weight |
|---|---|---|
| DI Water | $H_2O$ | 964.77 |
| Fluorozirconic acid | $H_2ZrF_6$ (40%) | 23.66 |
| Zirconium | $ZrO_2$ (37-43%), Zr (29.61%) | 2.82 |
| Silica | $SiO_2$ (33%) | 5.05 |
| Copper Nitrate Soln. 18% | Cu (18%) | 3.70 |
| Total: | | 1000 |

Formula 2 F/Zr: 5:1

| Raw Material | Molecule formula | Weight |
|---|---|---|
| DI Water | $H_2O$ | 961.49 |
| Fluorozirconic acid | $H_2ZrF_6$ (40%) | 23.66 |
| Zirconium | $ZrO_2$ (37-43%), Zr (29.61%) | 2.82 |
| Silica | $SiO_2$ (20%) | 8.33 |
| Copper Nitrate Soln. 18% | Cu (18%) | 3.70 |
| Total: | | 1000 |

Formula 3 F/Zr: 7:1

| Raw Material | Molecule formula | Weight |
|---|---|---|
| DI Water | $H_2O$ | 961.31 |
| Fluorozirconic acid | $H_2ZrF_6$ (40%) | 28.39 |
| Ammonium Bifluoride | $NH_4HF_2$ | 1.55 |
| Silica | $SiO_2$ (33%) | 5.05 |
| Copper Nitrate Soln. 18% | Cu (18%) | 3.70 |
| Total: | | 1000 |

Formula 4 F/Zr: 7:1

| Raw Material | Molecule formula | Weight |
|---|---|---|
| DI Water | $H_2O$ | 958.03 |
| Fluorozirconic acid | $H_2ZrF_6$ (40%) | 28.39 |
| Ammonium Bifluoride | $NH_4HF_2$ | 1.55 |
| Silica | $SiO_2$ (20%) | 8.33 |
| Copper Nitrate Soln. 18% | Cu (18%) | 3.70 |
| Total: | | 1000 |

Formula 5 F/Zr: 6:1

| Raw Material | Molecule formula | Weight |
|---|---|---|
| DI Water | $H_2O$ | 944.1 |
| HF | HF (95% F) | 13.38 |
| Zirconium oxynitrate Soln. | $ZrO_2$ (20% w/w), S.G. 1.43 | 33.77 |
| Silica | $SiO_2$ (33%) | 5.05 |
| Copper Nitrate Soln. 18% | Cu (18%) | 3.70 |
| Total: | | 1000 |

Formula 6 F/Zr: 6:1

| Raw Material | Molecule formula | Weight |
|---|---|---|
| DI Water | $H_2O$ | 940.82 |
| HF | HF (95% F) | 13.38 |
| Zirconium oxynitrate Soln. | $ZrO_2$ (20% w/w), S.G. 1.43 | 33.77 |
| Silica | $SiO_2$ (20%) | 8.33 |
| Copper Nitrate Soln. 18% | Cu (18%) | 3.70 |
| Total: | | 1000 |

Formula 7 F/Zr: 6:1

| Raw Material | Molecule formula | Weight |
|---|---|---|
| DI Water | $H_2O$ | 962.86 |
| Fluorozirconic acid | $H_2ZrF_6$ (40%) | 28.39 |
| Silica | $SiO_2$ (33%) | 5.05 |
| Copper Nitrate Soln. 18% | Cu (18%) | 3.70 |
| Total: | | 1000 |

Formula 8 F/Zr: 6:1

| Raw Material | Molecule formula | Weight |
|---|---|---|
| DI Water | $H_2O$ | 959.58 |
| Fluorozirconic acid | $H_2ZrF_6$ (40%) | 28.39 |
| Silica | $SiO_2$ (20%) | 8.33 |
| Copper Nitrate Soln. 18% | Cu (18%) | 3.70 |
| Total: | | 1000 |

Figure 2:
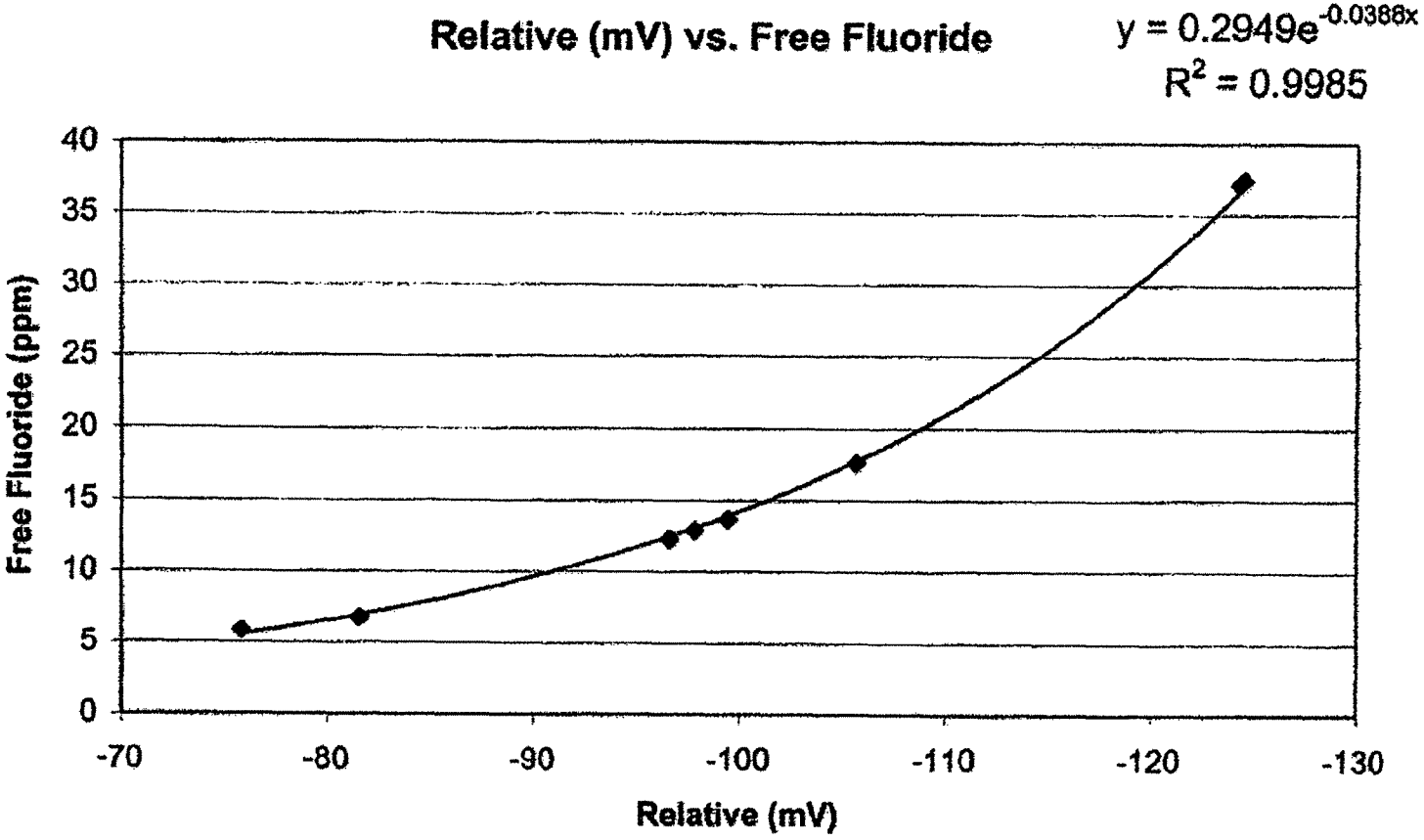
FIG. 2 is a plot of free fluoride concentration (ppm) versus relative mV measurement for several coating compositions.

Cold rolled steel substrates were coated with each composition and corrosion protection was evaluated as in Table 1b. The results are shown below in Table 2a. Additionally, free fluoride was measured and compared to relative Mv for each composition. These data are presented in Table 2b and is shown graphically in FIG. 2.

TABLE 2a

APGE Panel from Fluoride Study
mm of Creep (across the scribe)

| | Panel ID | Leg 1 | Leg 2 | Leg 3 | Leg 4 | Average | Total Avg. | ½ Average | Total ½ Avg. |
|---|---|---|---|---|---|---|---|---|---|
| Formula 1 | CRS1-1 | 4.01 | 4.37 | 6.56 | 5.43 | 5.09 | 6.11 | 2.55 | 3.06 |
| | CRS1-2 | 5.06 | 4.59 | 9.97 | 7.02 | 6.66 | | 3.33 | |
| | CRS1-3 | 5.34 | 8.49 | 6.48 | 6.04 | 6.59 | | 3.29 | |
| Formula 2 | CRS2-1 | 4.73 | 5.99 | 4.10 | 4.48 | 4.83 | 4.29 | 2.41 | 2.15 |
| | CRS2-2 | 3.51 | 5.23 | 3.67 | 3.93 | 4.09 | | 2.04 | |
| | CRS2-3 | 4.10 | 3.75 | 4.00 | 4.00 | 3.96 | | 1.98 | |

TABLE 2a-continued

| | APGE Panel from Fluoride Study mm of Creep (across the scribe) | | | | | | | | |
|---|---|---|---|---|---|---|---|---|---|
| | Panel ID | Leg 1 | Leg 2 | Leg 3 | Leg 4 | Average | Total Avg. | ½ Average | Total ½ Avg. |
| Formula 3 | CRS3-1 | 2.37 | 3.73 | 2.56 | 2.67 | 2.83 | 2.76 | 1.42 | 1.38 |
| | CRS3-2 | 2.79 | 2.79 | 2.86 | 3.76 | 3.05 | | 1.53 | |
| | CRS3-3 | 2.59 | 2.42 | 2.21 | 2.37 | 2.40 | | 1.20 | |
| Formula 4 | CRS4-1 | 3.39 | 3.23 | 2.56 | 3.25 | 3.11 | 3.33 | 1.55 | 1.67 |
| | CRS4-2 | 3.1 | 4.25 | 3.68 | 3.21 | 3.56 | | 1.78 | |
| | CRS4-3 | 3.2 | 3.54 | 3.55 | 3.03 | 3.33 | | 1.67 | |
| Formula 5 | CRS5-1 | 5.33 | 7.88 | 8.41 | 17.86 | 9.87 | 8.00 | 4.94 | 4.00 |
| | CRS5-2 | 5.49 | 4.66 | 5.04 | 7.75 | 5.74 | | 2.87 | |
| | CRS5-3 | 6.47 | 5.16 | 10.04 | 11.89 | 8.39 | | 4.20 | |
| Formula 6 | CRS6-1 | 5.96 | 5.36 | 5.05 | 5.01 | 5.35 | 4.89 | 2.67 | 2.44 |
| | CRS6-2 | 5.37 | 4.57 | 5.05 | 4.57 | 4.89 | | 2.45 | |
| | CRS6-3 | 4.05 | 5.36 | 3.76 | 4.56 | 4.43 | | 2.22 | |
| Formula 7 | CRS7-1 | 4.59 | 5.15 | 5.02 | 4.32 | 4.77 | 4.60 | 2.39 | 2.30 |
| | CRS7-2 | 5.4 | 5.33 | 5.31 | 4.27 | 5.08 | | 2.54 | |
| | CRS7-3 | 4.41 | 3.41 | 3.98 | 3.98 | 3.95 | | 1.97 | |
| Formula 8 | CRS8-1 | 3.36 | 4.97 | 2.58 | 3.83 | 3.69 | 3.59 | 1.84 | 1.79 |
| | CRS8-2 | 3.32 | 3.66 | 3.41 | 3.60 | 3.59 | | 1.75 | |
| | CRS8-3 | 3.68 | 3.74 | 3.26 | 3.66 | 3.59 | | 1.79 | |

TABLE 2b

| | pH | Relative (mV) | Free F- (ppm) | Total F- (ppm) | Temp. (° C.) |
|---|---|---|---|---|---|
| Formula 1 | 4.00 | −81.5 | 6.76 | 155 | 26 |
| Formula 2 | 3.98 | −75.8 | 5.88 | 154 | 27 |
| Formula 3 | 4.00 | −124.3 | 37.1 | 195 | 27 |
| Formula 4 | 4.00 | −124.5 | 37.4 | 194 | 27 |
| Formula 5 | 4.01 | −96.6 | 12.3 | 161 | 27 |
| Formula 6 | 4.01 | −97.8 | 12.9 | 160 | 27 |
| Formula 7 | 4.00 | −99.4 | 13.7 | 156 | 27 |
| Formula 8 | 3.99 | −105.6 | 17.6 | 169 | 27 |

Free Fluoride Study II:

Coating compositions in accordance with various embodiments of the present invention were prepared by mixing water and fluorozirconic acid, and adjusting the content of free fluoride via the addition of aluminum nitrate and/or ammonium bifluoride. Two comparative compositions having free fluoride contents of 343 ppm were also evaluated. Finally, Bonderite® 958, a commercially available zinc-phosphating product (Henkel Corp., Madison Heights, Mich.) was evaluated for comparative purposes.

Only the free fluoride content and total fluoride:zirconium ratios were varied, as shown below in Table 3. Each composition was then tested and evaluated for corrosion performance using another panel test method (GMW14872). The corrosion performance of each formulation is shown below in Table 3. In accordance with GMW14872, each panel was pretreated with a formulation and top-coated with a paint, and scribed as above. Each panel was then subjected to 31 cycles, and corrosion was measured. Corrosion is measured from one end of each corrosion line across the scribe line to the other end of the corrosion line, rather than from the scribe to the furthest end.

TABLE 3

| Free F (ppm) | RmV | Total F:Zr Molar Ratio | Zr (ppm) | Average Cyclic Corrosion (mm) |
|---|---|---|---|---|
| 8 | −90 | 6 | 150 | 6.1 |
| 19 | −110 | 6 | | 5.4 |
| 15 | −105 | 10.5 | | 5.2 |
| 28 | −120 | 10.5 | | 4.0 |

TABLE 3-continued

| Free F (ppm) | RmV | Total F:Zr Molar Ratio | Zr (ppm) | Average Cyclic Corrosion (mm) |
|---|---|---|---|---|
| 53 | −135 | 10.5 | | 5.7 |
| 8 | −90 | 12 | | 3.9 |
| 19 | −110 | 12 | | 5.0 |
| 43 | −130 | 12 | | 3.8 |
| 99 | −150 | 12 | | 5.7 |
| 8 | −90 | 15 | | 7.3 |
| 28 | −120 | 15 | | 6.7 |
| 99 | −150 | 15 | | 4.8 |
| 8 | −90 | 18 | | 3.1 |
| 19 | −110 | 18 | | 3.6 |
| 43 | −130 | 18 | | 6.6 |
| 99 | −150 | 18 | | 3.6 |
| 8 | −90 | 24 | | 7.8 |
| 19 | −110 | 24 | | 5.7 |
| 28 | −120 | 24 | | 3.7 |
| 43 | −130 | 24 | | 4.0 |
| 99 | −150 | 24 | | 4.1 |
| 8 | −90 | 6 | 750 | 5.9 |
| 53 | −135 | 6 | | 5.0 |
| 28 | −120 | 8 | | 5.0 |
| 99 | −150 | 8 | | 3.8 |
| 8 | −90 | 9 | | 6.0 |
| 53 | −135 | 9 | | 5.0 |
| 343 | −180 | 9 | | 9.1 |
| 28 | −120 | 10 | | 4.4 |
| 99 | −150 | 10 | | 4.0 |
| 8 | −90 | 12 | | 8.6 |
| 53 | −135 | 12 | | 5.4 |
| 343 | −180 | 12 | | 11.4 |
| Bonderite 958 Control | | | | 5.3 |

As shown in Table 3, compositions in accordance with various embodiments of the present invention exhibit corrosion performance comparable to, and in many cases better than the commercially available zinc-phosphating composition.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A method for increasing the corrosion resistance of steel substrates, comprising:

a) providing a plurality of steel substrates;

b) providing an aqueous coating composition comprising a fluoroacid compound of the formula (I):

$$X_pM_qF_rO_s \quad (I)$$

wherein each of q and r independently represents an integer of 1 to 10, each of p and s independently represents an integer from 0 to 10, X represents at least one cation selected from the group consisting of hydrogen, ammonium, alkaline earth metals, and alkali metals, and M represents at least one element selected from the group consisting of Ti, Zr, Hf, Si, Sn, Al, Ge, and B, the aqueous coating composition having an initial free fluoride content;

c) determining the free fluoride content of the aqueous coating composition; and d) adjusting the free fluoride content of the aqueous coating composition to a set free fluoride ion content by adding to the aqueous coating composition a component which alters free fluoride content selected from the group consisting of fluorine-free compounds of an element M, Group 2 metal compounds, Group 12 metal compounds, Group 13 compounds, Group 14 compounds, and combinations thereof;

e) determining a molar ratio of total fluoride:element M of the aqueous coating composition;

f) adjusting the total fluoride:element M molar ratio of the aqueous coating composition to a set molar ratio of total fluoride to element M; and g) contacting a steel substrate with the aqueous coating composition, wherein following the coating of one or more steel substrates, steps c) through g) are repeated a plurality of times, and the free fluoride content of step d) and the total fluoride to element M ratio of step f) are maintained during coating of a plurality of steel substrates.

2. The method according to claim 1, wherein a first determining of the free fluoride content of the aqueous coating composition takes place before contacting the aqueous coating composition with a first steel substrate.

3. The method of claim 1, wherein the steel of the plurality of steel substrates is one of cold rolled steel, hot rolled steel, and/or stainless steel.

4. The method of claim 1, wherein the content of free fluoride in at least step d) is adjusted to from 5 to 37.4 ppm.

5. The method of claim 4, wherein the molar ratio of total fluoride to element M in step f) is adjusted to from 4:1 to 24:1.

6. The method of claim 1, wherein the molar ratio of total fluoride to element M in at least step f) is adjusted to from 4:1 to 24:1.

7. The method of claim 1, wherein in step d), a fluorine-free compound of an element M wherein M in the fluorine-free compound is the same as M in the fluoroacid of formula (I) which is contained in the aqueous coating composition is added to adjust the free fluoride content.

8. The method of claim 7, wherein the aqueous coating composition further contains acid-stable particles.

9. The method of claim 7, wherein the fluorine-free compound added to the aqueous coating composition in step d) comprises a Group 12 metal compound.

10. The method of claim 9, wherein the Group 12 metal compound comprises a zinc salt.

11. The method of claim 1, wherein the aqueous coating composition further comprises acid-stable particles.

12. The method of claim 1, wherein the aqueous coating composition further comprises $Cu^{2+}$ ions.

13. The method of claim 1, wherein M in the formula (I) is Zr.

14. The method of claim 1, wherein the component added to the aqueous coating composition in step d) comprises a Group 12 metal compound.

15. The method of claim 1, wherein the free fluoride content is adjusted by adding a source of fluoride other than one of the formula (I).

16. The method of claim 15, wherein the source of fluoride is ammonium bifluoride.

17. The method of claim 1, wherein the molar ratio of total fluoride to element M is higher than 6:1.

18. A method for increasing the corrosion resistance of metal substrates, comprising:

a) providing a coating composition comprising a fluoroacid compound and acid-stable particles, wherein the fluoroacid compound comprises a compound of the formula (II):

$$X_pZrF_6 \quad (II)$$

wherein p represents an integer from 0 to 2;

X represents at least one cation selected from the group consisting of hydrogen, ammonium, alkaline earth metals, and alkali metals;

b) measuring free fluoride content of the coating composition before contacting a metal substrate with the coating composition;

c) contacting at least one metal substrate with the coating composition;

d) measuring the free fluoride content of the coating composition after contacting the at least one metal substrate with the coating composition;

e) adjusting the free fluoride content of the coating composition to a set free fluoride content after contacting the at least one metal substrate with the coating composition by adding basic zirconium carbonate to the coating composition together with a component which alters free fluoride content selected from the group consisting of fluorine-free compounds of an element M, selected from the group consisting of Ti, Zr, Hf, Si, Sn, Al, Ge, B and mixtures thereof, Group 2 metal compounds, Group 12 metal compounds, Group 13 compounds, Group 14 compounds, and combinations thereof, wherein the acid-stable particles have an average particle diameter from about 2 nm to about 80 nm; and controlling and maintaining the free fluoride content of step e) throughout the coating of a multiplicity of metal substrates.

19. The method of claim 18, wherein the metal substrate is selected from the group consisting of aluminum, cold rolled steel, hot-rolled steel, stainless steel, steel coated with zinc metal, steel coated with zinc alloys, hot-dipped galvanized steel, and combinations thereof.

20. The method of claim 18, wherein the free fluoride content in step e) is adjusted to a value in the range of 5 ppm to 37.4 ppm by the addition of the component which alters free fluoride content.

21. The method of claim 18, further comprising following step c) measuring the molar ratio of total fluoride to element M, and adjusting the ratio of a set value in the range of 4:1 to 24:1.

22. A method for treating metal substrates, comprising:

a) providing a coating composition having a pre-determined value of free fluoride content, the coating composition comprising a fluoroacid compound, silica particles, basic zirconium carbonate, and at least one component selected from the group consisting of fluorine-free compounds of an element of Ti, Zr, Hf, Si, Al, B, Sn or Ge, Group 2 metal compounds, Group 12 metal compounds, Group 13 compounds, Group 14 compounds, and combinations thereof, wherein the pre-determined free fluoride content is a value in a range of 10 ppm to 37.4 ppm;

wherein the fluoroacid compound comprises a compound of the formula (II):

$$X_pZrF_6 \quad \text{(II)}$$

wherein p represents an integer from 0 to 2;

X represents at least one cation selected from the group consisting of hydrogen, ammonium, alkaline earth metals, and alkali metals;

wherein the silica particles have an average particle diameter from about 2 nm to about 80 nm, and are present in the coating composition in an amount of 0.005% to 8% by weight, the fluoroacid is present in the coating composition in an amount of 0.0005% to 1% by weight;

b) contacting one or a plurality of metal substrates with the coating composition;

c) measuring free fluoride content of the coating composition after step b);

d) adjusting the free fluoride content of the coating composition to the pre-determined value;

e) adjusting a total fluoride:element M molar ratio of the coating composition to a value of more than 6:1; and f) controlling and maintaining the pre-determined value of free fluoride and the total fluoride:element M molar ratio of the coating composition throughout the coating process in which a plurality of metal substrates are coated, wherein element M, is selected from the group consisting of Ti, Zr, Hf, Si, Al, B, Sn, Ge and mixtures thereof.

23. The method of claim 22, wherein the value of the molar ratio of total fluoride to element M in step e) is in the range of 6:1 to 24:1.

* * * * *